US009156657B2

(12) United States Patent
Sturmer et al.

(10) Patent No.: US 9,156,657 B2
(45) Date of Patent: Oct. 13, 2015

(54) LIFT AND HOLD DEVICE

(76) Inventors: William J. Sturmer, Lemont, IL (US); Robert R. Workman, Jr., Tinley Park, IL (US)

( * ) Notice: Subject to any disclaimer, the term of this patent is extended or adjusted under 35 U.S.C. 154(b) by 1006 days.

(21) Appl. No.: 12/881,088

(22) Filed: Sep. 13, 2010

(65) Prior Publication Data

US 2011/0073413 A1 Mar. 31, 2011

Related U.S. Application Data

(60) Provisional application No. 61/241,561, filed on Sep. 11, 2009.

(51) Int. Cl.
*B66B 9/16* (2006.01)
*B66F 9/02* (2006.01)

(52) U.S. Cl.
CPC .... *B66B 9/16* (2013.01); *B66F 9/02* (2013.01)

(58) Field of Classification Search
CPC ..... B66B 9/16; B66B 9/187
USPC ..... 187/259, 261, 237; 414/630, 660, 664, 414/790.8, 794.1, 794.3, 794.6, 795.2, 801, 414/814, 631; 182/179.1, 222
See application file for complete search history.

(56) References Cited

U.S. PATENT DOCUMENTS

| | | | | | |
|---|---|---|---|---|---|
| 487,104 | A | * | 11/1892 | Tardy | 187/241 |
| 2,757,756 | A | * | 8/1956 | Warry | 187/243 |
| 2,843,280 | A | * | 7/1958 | Stopps | 414/607 |
| 2,943,708 | A | * | 7/1960 | Sasgen | 187/350 |
| 2,981,374 | A | * | 4/1961 | Holsclaw | 187/231 |
| 3,176,794 | A | * | 4/1965 | Evans et al. | 182/17 |
| 3,232,377 | A | * | 2/1966 | Smith | 182/115 |
| 3,385,401 | A | * | 5/1968 | Campbell et al. | 187/222 |
| 3,493,079 | A | * | 2/1970 | Dudschus | 182/141 |
| 3,743,115 | A | | 7/1973 | Saul, Jr. et al. | |
| 4,005,786 | A | | 2/1977 | Adelson et al. | |
| 4,183,423 | A | * | 1/1980 | Lewis | 182/103 |
| 4,546,854 | A | * | 10/1985 | Bocker | 182/103 |
| 4,646,922 | A | | 3/1987 | Smith | |
| 4,793,437 | A | * | 12/1988 | Hanthorn | 182/102 |
| 4,875,547 | A | * | 10/1989 | Hanthorn | 182/102 |
| 5,984,620 | A | | 11/1999 | Heston | |
| 6,012,552 | A | * | 1/2000 | Del Rio | 187/264 |
| 6,283,249 | B1 | * | 9/2001 | Young et al. | 182/17 |
| 6,325,586 | B1 | | 12/2001 | Loy | |
| 6,561,752 | B2 | | 5/2003 | Vincent et al. | |
| 7,159,521 | B2 | | 1/2007 | Salmanson et al. | |
| 7,311,487 | B1 | | 12/2007 | Crossley et al. | |
| 7,424,932 | B1 | * | 9/2008 | Murphy | 182/103 |

(Continued)

FOREIGN PATENT DOCUMENTS

| | | | |
|---|---|---|---|
| EP | 1195331 | A3 | 4/2002 |
| WO | WO 9631420 | A1 | 10/1996 |

(Continued)

*Primary Examiner* — Michael Mansen
*Assistant Examiner* — Stefan Kruer
(74) *Attorney, Agent, or Firm* — Heather Kartsounes

(57) ABSTRACT

This invention relates to a free standing lifting device which means that no additional support is required to support the lifting action of the device. The lifting device comprises a lift carriage further comprising at least one lift arm joined to a motor by way of a cable, at least one lift channel having a lift opening for receipt of the lift arm, at least one support arm and at least one support channel having a support opening for receipt of the support arm.

5 Claims, 1 Drawing Sheet

(56) References Cited

U.S. PATENT DOCUMENTS

| | | | |
|---|---|---|---|
| 7,559,285 | B2 | 7/2009 | Smith et al. |
| 2004/0226488 | A1 | 11/2004 | Zakaria et al. |
| 2005/0095093 | A1 | 5/2005 | Hansl |
| 2007/0276535 | A1 | 11/2007 | Haag |
| 2008/0093313 | A1 | 4/2008 | Huber |
| 2009/0148267 | A1 | 6/2009 | Crossley et al. |
| 2010/0303598 | A1* | 12/2010 | Wanek-Pusset et al. ..... 414/629 |

FOREIGN PATENT DOCUMENTS

| | | | |
|---|---|---|---|
| WO | WO0066463 | A1 | 11/2000 |
| WO | WO2005066438 | A2 | 7/2005 |

* cited by examiner

LIFT AND HOLD DEVICE

FIELD OF INVENTION

This invention relates to lifting and storage device. More specifically, this invention relates to a compact self-standing device that can lift and also hold items of significant weight.

BACKGROUND OF INVENTION

Lifting and storage devices are well known in prior art. Typically when a heavy, large, or bulky item, such as a pallet needs to be moved, a user will use a forklift to move the pallet into its desired location. However, at times there is a need to move a pallet into position and a forklift is not readily available or accessible to a user. Such a circumstance might be in a restaurant kitchen where space is limited and tight to maneuver large objects. Further, if a forklift or other means of movement isn't available a user may struggle to lift an item into place, putting the user into harm's way. As such there is a need, that this invention meets, for a free standing device that can lift and store large bulky items easily in a desired location.

SUMMARY OF INVENTION

This invention relates to a free-standing lifting device comprising:

- a lift carriage further comprising at least one lift arm joined to a motor by way of a cable;
- at least one lift channel having a lift opening for receipt of said lift arm;
- at least one support arm; and
- at least one support channel having a support opening for receipt of said support arm.

This lifting device is capable of being a free standing device which means that no additional support is required to support the lifting action of the device. However, one skilled in the art will recognize that it is possible to anchor or otherwise secure the lifting device if the user desires to take that action.

For purposes of describing this invention, the lift carriage will comprise at least one lift channel having a lift opening to receive a lift arm. One skilled in the art will recognize that only one lift arm or many lift arms can be used depending on the situation; i.e. many lift arms may be used in circumstances where there is more than one lift channel. When the user has an item that needs to be lifted, the lift arms are adjusted within the lift opening within the lift channel. The lift arms are adjustable and/or removable. It is anticipated that many lengths and widths of lift arms can be used depending on the situation.

One example of an item being lifted is in a situation whereby a user desires to lift a pallet. The lift arms support the pallet and the lift carriage is activated by way of a motor by way of a cable. One skilled in the art will recognize that the motor may be electric or hydraulic and that this invention is not confined to using a cable to join the motor to the lift carriage.

Once the lift carriage has reached the desired height, support arms are placed into the support openings within the support channels. These support arms are able to hold the pallet into a secure place until the user desires to move the pallet. This action also frees the lift carriage to be able to lift more items/pallets into a desired position by using the above described system without disturbing the integrity of the system.

The lift carriage can move vertically by way of flange rollers within the lifting device. This allows for smooth movement along the length of the lifting device.

The lift arms and support arms preferably twist lock into position within the respective openings. This creates a cantilevered position of the lift and support arms. A twist lock movement is preferred to ensure proper placement and locking of the lift arms or support arms. If a user has to twist a lift arm or support arm into place, it provides an added level of secure support.

Other advantages and aspects of the present invention will become apparent upon reading the following description of the drawings and the detailed description of a preferred embodiment of the invention.

DETAILED DESCRIPTION OF THE DRAWINGS

DETAILED DESCRIPTION OF THE PREFERRED EMBODIMENT

Figure 1:
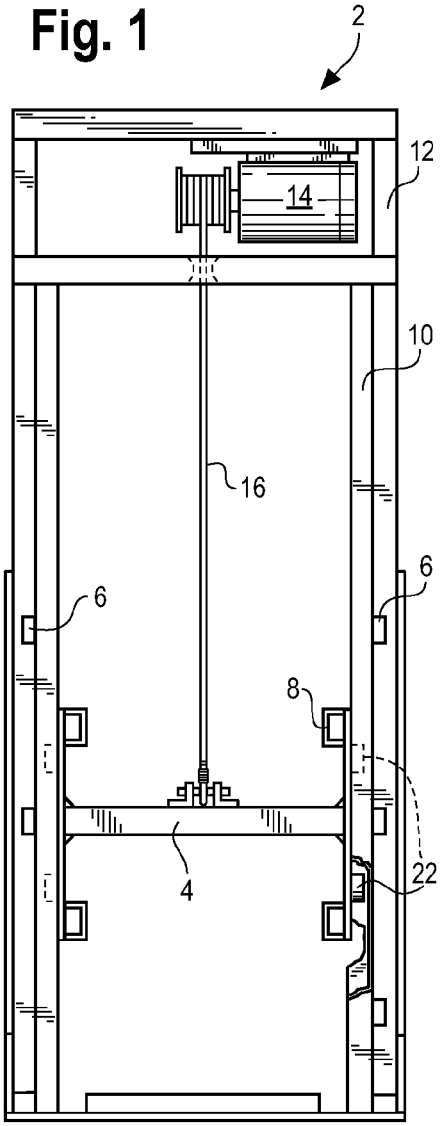
FIG. 1 depicts the free-standing lifting device.
Figure 2:
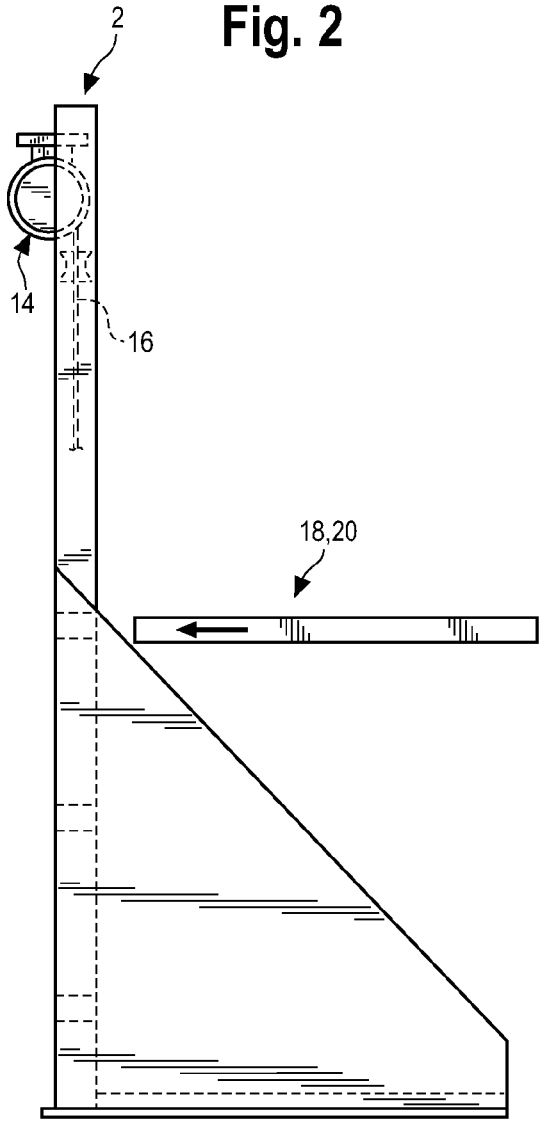
FIG. 2 depicts a side view of the free standing lifting device.

FIG. 1 is a detailed view of the free standing lifting device 2. As seen in FIG. 1, this lifting device 2 comprises at least one removable lift arm 18, a lift carriage 4 joined to a motor by way of a cable 16 and movably joined along an at least one lift channel 10 by flange rollers 22, at least one removable support arm 20, and at least one support channel 12 having a support opening 6 for receipt of the support arm 20.

FIG. 1 depicts a situation whereby there are two lift channels 10 and two support channels 12. There are lift openings 8 located on the lift carriage 4. Each of the two support channels 12 has at least one support opening 6. FIG. 1 depicts this as two support openings 6 within the support channels 12. Upon activation of the lifting device 2, a first item (not shown) is positioned on the lift carriage 4. The lift arms 18 are adjusted within the lift opening 8 and hold the first item (not shown) into position. The motor 14 drives the lift carriage 4 to a desired height by way of the cable 16. Flange rollers 22 are mounted on the lift carriage 4 and allow the carriage 4 to move in a rolling fashion along the lift channels 10 within the lifting device 2.

Once the lift carriage 4 has reached the desired height, the support arms 20 are placed into each of the support openings 6 within the support channels 12. These support arms 20 are able to support the first item (not shown) into a desired position.

If a user desires to lift a second item into position while the first item (not shown) is in place, it is possible to use the lift carriage 4 again for lifting without affecting the integrity of the first item's (not shown) position. This will also not affect the balance or structural integrity of the lifting device 2. The lift arms are again placed into the lift channel by way of the lift opening 8. Once the second item is positioned on the lift arms 18, the motor can again raise the lift carriage 4 into a desired location. Once that location is reached, support arms 20 can be placed into the support channel 12 by way of the support openings 6. Both the first and second items (not shown) can now be supported within the lifting device 2 and the lift carriage 4 is free to lift other items if needed.

It will be appreciated that the embodiments disclosed herein are not limiting on the scope of the invention and that variations and modifications may be made without departing from the spirit and scope of the invention.

What is claimed is:

1. A lifting device comprising:

at least one removable lift arm;

a lift carriage joined to a motor by way of a cable and movably joined along an at least one lift channel by flange rollers;

at least one removable support arm; and at least one support channel having a support opening for receipt of said at least one removable support arm;

wherein the lifting device is free standing;

wherein said at least one removable lift arm is received into a lift opening and, upon activation of the motor joined to the lift carriage, said lift carriage can raise or lower along said at least one lift channel a first item positioned on the at least one removable lift arm to a desired height and wherein said first item can be supported in a stationary manner by the at least one removable support arm being received into the at least one support channel; and wherein the lifting device can lift a second item when the first item is supported in a stationary manner at the desired height; wherein the second item positioned on the at least one removable lift arm can be lifted to a second desired height when the at least one removable lift arm is received into the lift opening and, upon activation of the motor joined to the lift carriage, said lift carriage can travel along said at least one lift channel to the second desired height; and, wherein the second item can be supported in a stationary manner by at least one removable support arm received into the at least one support channel.

2. The lifting device as in claim 1 wherein the at least one removable lift arm can be received into the lift opening in a cantilevered manner and the at least one removable support arm can be received into the support opening in a cantilevered manner.

3. The lifting device as in claim 1 wherein said at least one removable lift arm is removable from the lift opening when said at least one removable support arm is received into the support channel and said first item is resting upon said at least one removable support arm.

4. The lifting device of claim 1 wherein the at least one lift channel is more than one lift channel and wherein the at least one support channel is more than one support channel.

5. The lifting device of claim 1 wherein the second item may be lifted to a lower height than the first item when the first item is in a stationary position.

* * * * *